US007569528B2

(12) United States Patent
Lant et al.

(10) Patent No.: US 7,569,528 B2
(45) Date of Patent: Aug. 4, 2009

(54) DETERGENT COMPOSITIONS

(75) Inventors: Neil Joseph Lant, Newcastle upon Tyne (GB); Allan Campbell McRitchie, Tyne & Wear (GB); Jonathan Richard Clare, Newcastle upon Tyne (GB); Philip Frank Souter, Northumberland (GB); Javier Medina, Newcastle upon Tyne (GB); Zaiyou Liu, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 263 days.

(21) Appl. No.: 11/287,943

(22) Filed: Nov. 28, 2005

(65) Prior Publication Data

US 2006/0128586 A1 Jun. 15, 2006

Related U.S. Application Data

(60) Provisional application No. 60/724,758, filed on Oct. 7, 2005.

(30) Foreign Application Priority Data

Nov. 29, 2004 (EP) ..... 04257384

(51) Int. Cl.
*C11D 3/50* (2006.01)

(52) U.S. Cl. ..... 510/101; 510/392; 510/393; 510/405; 510/466; 512/25

(58) Field of Classification Search ..... 510/392, 510/466, 405, 101, 393; 512/25
See application file for complete search history.

(56) References Cited

U.S. PATENT DOCUMENTS

| | | | | |
|---|---|---|---|---|
| 5,869,438 | A | 2/1999 | Svendsen et al. | |
| 6,140,295 | A * | 10/2000 | Behan et al. | 510/320 |
| 6,245,732 | B1 | 6/2001 | Gallon et al. | |
| 6,495,357 | B1 | 12/2002 | Fuglsang et al. | |
| 6,624,129 | B1 | 9/2003 | Borch et al. | |
| 6,833,346 | B1 * | 12/2004 | Morrison et al. | 510/444 |
| 6,939,702 | B1 | 9/2005 | Vind et al. | |
| 7,098,178 | B2 * | 8/2006 | Gerke et al. | 510/466 |
| 2004/0053360 | A1 | 3/2004 | Munk et al. | |

FOREIGN PATENT DOCUMENTS

EP 0 430 315 A2 6/1991

OTHER PUBLICATIONS

PCT International Search Report—3 Pages.

* cited by examiner

*Primary Examiner*—Bernard Lipman
(74) *Attorney, Agent, or Firm*—Ronald Terk Sia; David V. Upite; Kim William Zerby

(57) ABSTRACT

Detergent compositions comprising high efficiency lipase enzymes and particles comprising encapsulated perfumes. Preferred perfumes have a boiling point at 760 mm Hg, of 260° C. or lower and a calculated CLogP of at least 3.0.

The encapsulated perfume particles are useful in laundry compositions in order to provide efficacious perfume delivery at all stages of the wash, particularly during the laundering stage.

20 Claims, No Drawings

DETERGENT COMPOSITIONS

CROSS-REFERENCES TO RELATED APPLICATIONS

This application claims priority under 35 U.S.C. § 119(e) to U.S. Provisional Application Ser. No. 60/724,758 filed Oct. 7, 2005.

TECHNICAL FIELD

The present invention relates to detergent compositions, particularly laundry detergent compositions and in particular to detergents comprising lipolytic or lipase enzymes.

BACKGROUND OF THE INVENTION AND PRIOR ART

Lipase enzymes have been used in detergents since the late 1980s for removal of fatty soils. It is known that lipase enzymes impact perfumes of detergent compositions containing them. The selection of perfumes for use in detergent compositions comprising lipase enzymes is documented in EP-A-430315, where it is described that in order to combat malodours resulting from the use of lipase enzymes, perfumes should be used that comprise at least 25% by weight of defined perfume materials and less than 50% by weight of esters derived from fatty acids with 1-7 carbon atoms.

Until relatively recently, the main commercially available lipase enzymes worked particularly effectively at the lower moisture levels of the drying phase of the wash process. However, more recently, higher efficiency lipases have been developed that also work effectively during the wash phase of the cleaning process. Examples of such enzymes are as described in WO00/60063 and Research Disclosure IP6553D. This makes it even more difficult for the detergent formulator to produce consumer acceptable perfumes in a climate where consumers' expectation is increasingly for pleasant perfumes at all stages of the washing process. One particular area where the impact of lipase on the perfume in the detergent composition can be most noticeable to consumers is after storage and as a result, during the washing process. This can be a particular problem for detergents for use in hand-washing processes. The present inventors have found that the problems described above can be alleviated even for detergent formulations comprising the new high efficiency lipase enzymes. Furthermore, the present inventors have found specific preferred perfumes for use in such detergent formulations.

DEFINITION OF THE INVENTION

In accordance with the present invention there is provided a detergent composition comprising:

1. a lipase which is a polypeptide having an amino acid sequence which: (a) has at least 90% identity with the wild-type lipase derived from *Humicola lanuginosa* strain DSM 4109; (b) compared to said wild-type lipase, comprises a substitution of an electrically neutral or negatively charged amino acid at the surface of the three-dimensional structure within 15 Angstroms of E1 or Q249 with a positively charged amino acid; and (c) comprises a peptide addition at the C-terminal; and/or (d) comprises a peptide addition at the N-terminal and/or (e) meets the following limitations: i) comprises a negative amino acid in position E210 of said wild-type lipase; ii) comprises a negatively charged amino acid in the region corresponding to positions 90-101 of said wild-type lipase; and iii) comprises a neutral or negative amino acid at a position corresponding to N94 of said wild-type lipase and/or has a negative or neutral net electric charge in the region corresponding to positions 90-101 of said wild-type lipase; and
2. an encapsulated perfume particle comprising (a) an at least partially water-soluble solid matrix comprising one or more water-soluble hydroxylic compounds, preferably starch; and (b) a perfume oil encapsulated by the solid matrix.

The lipase enzyme may be a polypeptide as defined above, meeting criteria (a) and (b) and (c) and/or (e).

In a further embodiment of the invention, the encapsulated perfume oil comprises at least 1% by weight or at least 5 wt % or even at least 10% by weight, or even at least 20%, 30, 40, 50, 60, 70, 80 or 90% by weight of at least one perfume ingredient having a boiling point at 36 $KNm^{-2}$ (760 mmHg) of 260° C. or lower and a calculated $\log_{10}$ of its octanol/water coefficient P (ClogP), of at least 3.0. In a further embodiment, the encapsulated perfume oil comprises at least one ester derived from fatty acids with 1-7 carbon atoms, generally at least 1% by weight or at least 5 wt % or even at least 10% by weight, or even at least 20%, 30, 40, 50, 60, 70, 80 or 90 wt % ester by weight based on the weight of the total perfume oil in the encapsulated perfume particle. The inventors have found that two particular perfume esters are especially sensitive to the presence of lipase enzymes so that the invention is particularly beneficial where the encapsulated perfume oil comprises benzyl acetate and/or phenylethyl acetate.

In a further embodiment of the invention, there is provided a detergent composition comprising a perfume composition, said perfume composition comprising the perfume oil in the encapsulated perfume particle and any optional additional pefume oil, said perfume composition comprising at least 10% by weight, or at least 20, 30, 40, 50, 60, 70, 80 or even 90 wt % of one or more perfume components having a molecular weight of greater than 0 but less than or equal to 350 daltons, at least 80% of said one or more perfume components having a cLogP of at least 2.4, said perfume composition comprising at least 5% of said one or more perfume components having a cLogP of at least 2.4.

DETAILED DESCRIPTION OF THE INVENTION

All percentages and ratios herein are calculated by weight unless otherwise indicated. Percentages and ratios are calculated based on the total composition unless otherwise indicated. The nomenclature used herein describing the enzymes, for example relating to amino acid modifications, amino acid groupings and amino acid identity is as in WO00/60063.

The lipase enzymes suitable for use in the present invention may be selected from the group consisting of enzymes capable of hydrolyzing ester bonds, classified by EC number 3.1, preferably enzymes that hydrolyze carboxylic ester bonds, classified by EC number 3.1.1 Within this class, particularly preferred are lipases classified by EC number 3.1.1.3 and most preferred are those with first wash performance such as are described in WO00/60063, WO99/42566, WO02/062973, WO97/04078, WO97/04079 and U.S. Pat. No. 5,869,438.

The preferred lipase enzymes are described in WO00/60063. The preferred lipases suitable for use in the present invention as described in WO00/60063 are described with reference to a lipase that is the wild-type lipase derived from *Humicola Lanuginosa* strain DSM 4109 (reference lipase). The reference lipase is also referred to as Lipolase (registered trade name of Novozymes). It is described in EP258068 and EP305216 and has the amino acid sequence shown in positions 1-269 of SEQ ID No 2 of U.S. Pat. No. 5,869,438.

The most preferred first wash lipase for use in the present invention is available under the tradename LIPEX (registered tradename of Novozymes), a variant of the *Humicola lanuginosa* (*Thermomyces lanuginosus*) lipase (Lipolase registered tradename of Novozymes) with the mutations T231R and N233R.

The lipase enzyme incorporated into the detergent compositions of the present invention is generally present in an amount of 10 to 20000 LU/g of the detergent composition, or even 100 to 10000 LU/g. The LU unit for lipase activity is defined in WO99/42566. The lipase dosage in the wash solution is typically from 0.02 to 2 mg/l enzyme, more typically from 0.1 to 2 mg/l as enzyme protein.

The lipase enzyme may be incorporated into the detergent composition in any convenient form, generally in the form of a non-dusting granulate, a stabilised liquid or a coated enzyme particle. Alternatively a slurry may be suitable.

The at least partially water soluble hydroxylic compounds useful herein are preferably selected from carbohydrates, which can be any or mixture of: i) simple sugars (or monosaccharides); ii) oligosaccharides (defined as carbohydrate chains consisting of 2-10 monosaccharide molecules); iii) polysaccharides (defined as carbohydrate chains consisting of at least 11, or more usually at least 35 monosaccharide molecules); and iv) starches.

Both linear and branched carbohydrate chains may be used. In addition chemically modified starches and poly-/oligo-saccharides may be used. Typical modifications include the addition of hydrophobic moieties of the form of alkyl, aryl, etc. identical to those found in surfactants to impart some surface activity to these compounds.

Other examples of suitable encapsulating materials include all natural or synthetic gums such as alginate esters, carrageenin, agar-agar, pectic acid, and natural gums such as gum arabic, gum tragacanth and gum karaya, chitin and chitosan, cellulose and cellulose derivatives including i) cellulose acetate and cellulose acetate phthalate (CAP); ii) hydroxypropyl methyl cellulose (HPMC); iii)carboxymethylcellulose (CMC); iv) all enteric/aquateric coatings and mixtures thereof.

Particularly preferred encapsulating matrix materials comprise starches. Suitable examples can be made from, raw starch, pregelatinized starch, modified starch derived from tubers, legumes, cereal and grains, for example corn starch, wheat starch, rice starch, waxy corn starch, oat starch, cassava starch, waxy barley, waxy rice starch, sweet rice starch, amioca, potato starch, tapioca starch, oat starch, cassava starch, and mixtures thereof.

Modified starches suitable for use as the encapsulating matrix in the present invention include, hydrolyzed starch, acid thinned starch, starch esters of long chain hydrocarbons, starch acetates, starch octenyl succinate, and mixtures thereof.

The term "hydrolyzed starch" refers to oligosaccharide-type materials that are typically obtained by acid and/or enzymatic hydrolysis of starches, preferably corn starch. Suitable hydrolyzed starches for inclusion in the present invention include maltodextrins and corn syrup solids. The hydrolyzed starches for inclusion with the mixture of starch esters have a Dextrose Equivalent (DE) values of from about 10 to about 36 DE. The DE value is a measure of the reducing equivalence of the hydrolyzed starch referenced to dextrose and expressed as a percent (on a dry basis). The higher the DE value, the more reducing sugars present. A method for determining DE values can be found in Standard Analytical Methods of the Member Companies of Corn Industries Research Foundation, 6th ed. Corn Refineries Association, Inc. Washington, D.C. 1980, D-52.

Starch esters having a degree of substitution in the range of from about 0.01% to about 10.0% may be used to encapsulate the perfume oils of the present invention. The hydrocarbon part of the modifying ester should be from a $C_5$ to $C_{16}$ carbon chain. Preferably, octenylsuccinate (OSAN) substituted waxy corn starches of various types such as 1) waxy starch: acid thinned and OSAN substituted, 2) blend of corn syrup solids: waxy starch, OSAN substituted, and dextrinized, 3) waxy starch: OSAN substituted and dextrinized, 4) blend of corn syrup solids or maltodextrins with waxy starch: acid thinned OSAN substituted, and then cooked and spray dried, 5) waxy starch: acid thinned and OSAN substituted then cooked and spray dried, and 6) the high and low viscosities of the above modifications (based on the level of acid treatment) can also be used in the present invention.

Modified starches having emulsifying and emulsion stabilizing capacity such as starch octenyl succinates have the ability to entrap the perfume oil droplets in the emulsion due to the hydrophobic character of the starch modifying agent. The perfume oils remain trapped in the modified starch until dissolved in the wash solution, due to thermodynamic factors i.e., hydrophobic interactions and stabilization of the emulsion because of steric hindrance. The perfume may be adsorbed or adsorbed onto a carrier prior to encapsulation. Suitable examples of carriers are as described in WO 97/11151 or may be polymeric materials. Zeolite is a particularly preferred carrier, for example as described in more detail in WO97/11151.

Other known methods of manufacturing the starch encapsulates of the present invention, include but are not limited to, fluid bed agglomeration, extrusion, cooling/crystallization methods and the use of phase transfer catalysts to promote interfacial polymerization.

Other suitable matrix materials and process details are disclosed in, e.g., U.S. Pat. No. 3,971,852, Brenner et al., issued Jul. 27, 1976.

Perfume Oils

As used herein, the expression "perfume oil" is intended to refer to perfume raw materials or ingredients, or combinations thereof. Whilst these are generally immiscible with water under standard conditions of temperature and pressure, a small number may be miscible with water. The perfume oil may comprise one perfume ingredient or mixtures of more than one perfume ingredient. In addition to the perfume oil present in the detergent compositions of the invention via the encapsulated perfume particle, additional perfume oils may be present in the detergent via other delivery systems as discussed below. The overall sum of perfume ingredients present in the encapsulated perfume oil and any optional additional perfume oils provides the perfume composition of the detergent composition.

The inventors have found that often lipase enzymes and particularly the high efficiency lipase enzymes essential for the present invention, are problematic for perfume stability on storage and this means that the perfume fragrance detected by the consumer is not only reduced compared with the amount of perfume added into the detergent formulation but may also be adversely affected so that it is not the perfume selected by the perfumer. This problem is particularly noticeable by the consumer during the washing process and the inventors have found that not only do the encapsulated perfumes have a degree of protection on storage, but also surprisingly, the encapsulated perfumes appear to be chaperoned to the surface of the wash water by the encapsulate, providing maximum efficacy for the perfume raw materials used. The use of the encapsulated perfumes in combination with the specified lipases also provides a degree of protection from these particularly lipase-sensitive perfume raw materials.

Preferably the perfume oil present in the encapsulated perfume particle comprises one or more perfume ingredient characterized by its boiling point (B.P.) and its octanol/water partition coefficient (P). The octanol/water partition coefficient of a perfume ingredient is the ratio between its equilibrium concentrations in octanol and in water. The preferred perfume ingredients of this invention have a B.P., determined at the normal, standard pressure of about 760 mm Hg, of about 260° C. or lower, preferably less than about 255° C.; and more preferably less than about 250° C., and an octanol/water partition coefficent P of about 1,000 or higher. Since the partition coefficients of the preferred perfume ingredients of this invention have high values, they are more conveniently given in the form of their logarithm to the base 10, logP. Thus the preferred perfume ingredients of this invention have logP of at least 3, preferably more than 3.1, and even more preferably more than 3.2.

The boiling points of many perfume ingredients are given in, e.g., "Perfume and Flavor Chemicals (Aroma Chemicals)," Steffen Arctander, published by the author, 1969, incorporated herein by reference.

The logP of many perfume ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are preferably used instead of the experimental logP values in the selection of perfume ingredients which are useful in the present invention.

Thus, when a perfume composition which is composed of ingredients having a B.P. of about 260° C. or lower and a ClogP, or an experimental logP, of about 3 or higher, is used in an detergent composition, the perfume is very effusive and very noticeable when the product is used. Table 1 gives some non-limiting examples of the preferred perfume ingredients, useful in the detergent compositions of the present invention. Particularly preferred perfume oils for encapsulation, include one or a mixture of more than one ingredient selected from octyl aldehyde, nonyl aldehyde, decyl aldehyde, dodecyl aldehyde (dodecanal or lauric aldehye), diphenyl oxide, alpha-Ionine, Lilial and alpha-iso "gamma" methyl Ionone. These have been found to be particularly useful for masking malodours produced from fatty acid odours. These particularly preferred perfume oils may be encapsulated singly or as part of a mixture with other preferred (i.e. listed in Table 1 below) or particularly preferred perfume oils or as part of a mixture with other perfume oils.

TABLE 1

Examples of Preferred Perfume Ingredients

| Perfume Ingredients | Approx. BP (° C.) | Approx. ClogP |
|---|---|---|
| allo-Ocimene | 192 | 4.362 |
| Allyl Heptoate | 210 | 3.301 |
| Anethol | 236 | 3.314 |
| Benzyl Butyrate | 240 | 3.698 |
| Camphene | 159 | 4.192 |
| Carvacrol | 238 | 3.401 |
| beta-Caryophyllene | 256 | 6.333 |
| cis-3-Hexenyl Tiglate | 101 | 3.700 |
| Citral (Neral) | 228 | 3.120 |
| Citronellol | 225 | 3.193 |
| Citronellyl Acetate | 229 | 3.670 |
| Citronellyl Isobutyrate | 249 | 4.937 |
| Citronellyl Nitrile | 225 | 3.094 |
| Citronellyl Propionate | 242 | 4.628 |
| Cyclohexyl Ethyl Acetate | 187 | 3.321 |
| Decyl Aldehyde | 209 | 4.008 |
| Dihydro Myrcenol | 208 | 3.030 |
| Dihydromyrcenyl Acetate | 225 | 3.879 |
| Dimethyl Octanol | 213 | 3.737 |
| Diphenyl Oxide | 252 | 4.240 |
| Dodecalactone | 258 | 4.359 |
| Ethyl Methyl Phenyl Glycidate | 260 | 3.165 |
| Fenchyl Acetate | 220 | 3.485 |
| gamma Methyl Ionone | 230 | 4.089 |
| gamma-n-Methyl Ionone | 252 | 4.309 |
| gamma-Nonalactone | 243 | 3.140 |
| Geranyl Acetate | 245 | 3.715 |
| Geranyl Formate | 216 | 3.269 |
| Geranyl Isobutyrate | 245 | 4.393 |
| Geranyl Nitrile | 222 | 3.139 |
| Hexenyl Isobutyrate | 182 | 3.181 |
| Hexyl Neopentanoate | 224 | 4.374 |
| Hexyl Tiglate | 231 | 3.800 |
| alpha-Ionone | 237 | 3.381 |
| beta-Ionone | 239 | 3.960 |
| gamma-Ionone | 240 | 3.780 |
| alpha-Irone | 250 | 3.820 |
| Isobornyl Acetate | 227 | 3.485 |
| Isobutyl Benzoate | 242 | 3.028 |
| Isononyl Acetate | 200 | 3.984 |
| Isononyl Alcohol | 194 | 3.078 |
| Isobutyl Quinoline | 252 | 4.193 |
| Isomenthol | 219 | 3.030 |
| para-Isopropyl Phenylacetaldehyde | 243 | 3.211 |
| Isopulegol | 212 | 3.330 |
| Lauric Aldehyde (Dodecanal) | 249 | 5.066 |
| Lilial (p-t-Bucinal) | 258 | 3.858 |
| d-Limonene | 177 | 4.232 |
| Linalyl Acetate | 220 | 3.500 |
| Menthyl Acetate | 227 | 3.210 |
| Methyl Chavicol | 216 | 3.074 |
| alpha-iso "gamma" Methyl Ionone | 230 | 4.209 |
| Methyl Nonyl Acetaldehyde | 232 | 4.846 |
| Methyl Octyl Acetaldehyde | 228 | 4.317 |
| Myrcene | 167 | 4.272 |
| Neral | 228 | 3.120 |
| Neryl Acetate | 231 | 3.555 |
| Nonyl Acetate | 212 | 4.374 |
| Nonyl Aldehyde | 212 | 3.479 |
| Octyl Aldehyde | 223 | 3.845 |
| Orange Terpenes (d-Limonene) | 177 | 4.232 |
| para-Cymene | 179 | 4.068 |
| Phenyl Heptanol | 261 | 3.478 |
| Phenyl Hexanol | 258 | 3.299 |
| alpha-Pinene | 157 | 4.122 |
| beta-Pinene | 166 | 4.182 |
| alpha-Terpinene | 176 | 4.412 |
| gamma-Terpinene | 183 | 4.232 |
| Terpinolene | 184 | 4.232 |
| Terpinyl acetate | 220 | 3.475 |
| Tetrahydro Linalool | 191 | 3.517 |
| Tetrahydro Myrcenol | 208 | 3.517 |
| Tonalid | 246 | 6.247 |
| Undecenal | 223 | 4.053 |

TABLE 1-continued

| Examples of Preferred Perfume Ingredients | | |
|---|---|---|
| Perfume Ingredients | Approx. BP (° C.) | Approx. ClogP |
| Veratrol | 206 | 3.140 |
| Verdox | 221 | 4.059 |
| Vertenex | 232 | 4.060 |

The perfume oil in the encapsulated perfume particle may be adsorbed or absorbed onto a carrier prior to encapsulation. Suitable carriers are described in WO97/11151. A particularly preferred carrier is zeolite.

The detergent compositions herein comprise from about 0.01% to 50% of the encapsulated perfume particle. More preferably, the detergent compositions herein comprise from 0.05% to 8.0% of the perfume particle, even more preferably from 0.5% to 3.0%. Most preferably, the detergent compositions herein contain from 0.05% to 1.0% of the encapsulated perfume particle. The encapsulated perfume particles preferably have size of from 1 micron to 1000 microns, more preferably from 50 microns to 500 microns.

The perfume oil and/or perfume composition is generally present in the detergent compositions of the invention in amounts of from 0.001% to about 5%, preferably from 0.01% to 5%, and more usually from 0.05% to 3%. Where present in the detergent compositions of the present invention, the preferred perfume ingredients may comprise 100% of the perfume oil, but is more usually used in addition to other perfume ingredients. A mixture of more than one of the preferred perfume ingredients may be present for example, at least 2 or even at least 5 or 6 or 7 different preferred perfume ingredients. Furthermore, the encapsulated perfume particles may contain at least 1 or 5 or 10 wt % or even at least 20, 30, 40, 50, 60, 70, 80 or 90 wt % of such preferred perfume ingredients.

Most common perfume ingredients which are derived from natural or synthetic sources are composed of a multitude of components. For example, orange terpenes contain about 90% to about 95% d-limonene, but also contain many other minor ingredients. When each such material is used in the formulation of the perfume oils in the present invention, it is counted as one ingredient, for the purpose of defining the invention.

The detergent compositions may comprise in addition to the encapsulated perfume oil, additional perfume oil forming part of the total perfume composition in the detergent composition. The additional perfume oil may be incorporated into the detergent composition by any other delivery method, for example, simply by spraying onto the finished detergent composition or onto a component thereof, prior to mixing to form the finished detergent composition.

The encapsulated perfume particles also may comprise perfume oil comprising esters derived from fatty acids having 1 to 7 carbon atoms. Where the detergent composition additionally comprises additional perfume oil, preferably at least 60 wt %, or at least 80 or 90 or substantially all the ester derived from fatty acid having from 1 to 7 carbon atoms will be present in the encapsulated perfume particles.

In a further aspect of the invention, the encapsulated perfume oil and/or the perfume composition in the detergent composition comprises at least 10%, 20%, 30%, 40%, 50%, 60%, 70%, 80%, or even 90% of one or more perfume ingredients having a molecular weight of greater than 0 but less than or equal to 350 daltons, from about 100 daltons to about 350 daltons, from about 130 daltons to about 270 daltons, or even from about 140 daltons to about 230 daltons; at least 80%, 85%, 90% or even 95% of said one or more perfume ingredients having a cLogP of at least 2.4, from about 2.75 to about 8.0 or even from about 2.9 to about 6.0, said perfume composition comprising at least 5%, 15%, 25%, 35%, 45%, 55%, 65%, 75%, 85%, or even 95% of said one or more perfume ingredients having a cLogP in the range of at least 2.4, from about 2.75 to about 8.0 or even from about 2.9 to about 6.0. In said aspect of the invention said one or more perfume ingredients may be selected from the group consisting of a Schiff's base, ether, phenol, ketone, alcohol, ester, lactone, aldehyde, nitrile, natural oil or mixtures thereof. Schiff's base and nitrites may be least preferred. In certain aspects of the invention as recited above, said one or more perfume ingredients may include Table 2 Perfume Ingredients or mixtures thereof or even Table 2 Perfume Ingredients 1 through 28 or mixtures thereof. It may be preferred for ketones and aldehydes to have a molecular weight of below 200 daltons.

In another aspect of the invention said perfume composition comprises at least 10% 20%, 30%, 40%, 50%, 60%, 70%, 80%, or even 90% of a perfume ingredient selected from the group consisting of the ingredients listed in Table 2 below and mixtures thereof.

TABLE 2

| | Chemical Name | CAS | Functionality | M Wt | clogP |
|---|---|---|---|---|---|
| 1 | 2-Methoxynaphthalene | 93-04-9 | Ether | 158 | 3.24 |
| 2 | Diphenyl ether | 101-84-8 | Ether | 170 | 4.24 |
| 3 | 2-methoxy-4-propenyl phenol | 120-11-6 | Phenol | 164 | 4.63 |
| 4 | 2-Methoxy-4 allyl phenol | 97-53-0 | Phenol | 164 | 2.40 |
| 5 | 4-Penten-1-one,1-(5,5-dimethyl-1-cyclohexen-1-yl) | 56973-85-4 | Ketone | 192 | 4.0 |
| 6 | (1alpha(E),2 beta) - 1-(2,6,6-Trimethyl-cyclohex-3-en-1-yl)but-2-en-1-one | 71048-82-3 | Ketone | 192 | 3.62 |
| 7 | 3-Buten-2-one, 3-Methyl-4-(2,6,6-Trimethyl-2-Cyclohexen-1-yl) | 127-51-5 | Ketone | 206 | 4.0 |
| 8 | 2-(2-(4-methyl-3-cyclohexen-1-yl)propyl)cyclopentanone | 95962-14-4 | Ketone | 220 | 4.44 |
| 9 | 4-[(2,6,6-trimethyl-1-cyclohex-2-enyl)]but-3-en-2-one | 127-41-3 | Ketone | 192 | 3.71 |

TABLE 2-continued

| | Chemical Name | CAS | Functionality | M Wt | clogP |
|---|---|---|---|---|---|
| 10 | 1Buten-1-ol,2ethyl-4-(2,2,3-trimethyl-3-cyclopentyl-1-yl)- | 28219-61-6 | Alcohol | 208 | 4.43 |
| 11 | 2-Ethyl-4-(2,2,3-trimethylcyclopent-3-enyl-1)-2-buten-1-ol | 28219-61-6 | Alcohol | 208 | 4.43 |
| 12 | Cyclopentaneacetic acid,3oxo-2-pentyl-methyl ester | 24851-98-7 | Ester | 226 | 2.42 |
| 13 | Methyl 2-hexyl-3-oxo-cyclopentanecarboxylate | 37172-53-5 | Ester | 226 | 3.09 |
| 14 | Tricyclodecenyl Propionate | 17511-60-3 | Ester | 206 | 2.89 |
| 15 | Tricyclo Decenyl Acetate | 2500-83-6 | Ester | 190 | 2.36 |
| 16 | n-pentyl salicylate | 2050-08-0 | Ester | 208 | 4.56 |
| 17 | chromen-2-one or 1,2-benzopyrone | 91-64-5 | Lactone | 146 | 1.41 |
| 18 | 4-(tricycle(5,2,1,0)decylidene-8)butanal | 30168-23-1 | Aldehyde | 204 | 3.63 |
| 19 | 3-(3-isopropylphenyl)butanal | 125109-85-5 | Aldehyde | 190 | 3.55 |
| 20 | p-tert.Butyl-alpha-methyldihydrocinnamic aldehyde | 80-54-6 | Aldehyde | 204 | 3.86 |
| 21 | alpha-Hexylcinnamaldehyde | 101-86-0 | Aldehyde | 216 | 4.85 |
| 22 | n-octanal | 124-13-0 | Aldehyde | 128 | 2.95 |
| 23 | n-nonanal | 124-19-6 | Aldehyde | 142 | 3.98 |
| 24 | n-decanal | 10486-19-8 | Aldehyde | 156 | 5.60 |
| 25 | dodecanal | 112-54-9 | Aldehyde | 184 | 5.07 |
| 26 | Benzene propane nitrile alpha-ethenyl-alpha-methyl | 97384-48-0 | Nitrile | 171 | 2.31 |
| 27 | 2-cyclohexylidene-2-phenylacetonitrile | 104621-98-0 | Nitrile | 197 | n/a |
| 28 | Patchouli | n/a | Natural Oil | n/a | n/a |
| 29 | Naphtho[2,1-b]furan, dodecahydro-3a,6,6,9a-tetramethyl- | 3738-00-9 | Ether | 236 | 5.26 |
| 30 | Cyclopentanone, 2-pentyl- | 4819-67-4 | Ketone | 154 | 2.94 |
| 31 | Ethanone, 1-(1,2,3,4,5,6,7,8-octahydro-2,3,8,8-tetramethyl-2-naphthalenyl)- | 54464-57-2 | Ketone | 234 | 4.84 |
| 32 | 3-methyl-4(5)-cyclopentadecenone | 82356-51-2 | Ketone | 236 | 5.60 |
| 33 | 2(3H)-Furanone, 5-heptyldihydro- | 104-67-6 | Lactone | 184 | 3.83 |
| 34 | Methyl ionone (mixture) | 1335-46-2 | Ketone | 206 | 4.23 |
| 35 | Spiro[1,3-dioxolane-2,8'(5'H)-[2H-2,4a]methanonaphthalene], hexahydro-1',1',5',5'-tetramethyl-, [2'S-(2'.alpha.,4'a.alpha.,8'a.alpha.)]- | 154171-77-4 | Ketone | n/a | 5.67 |
| 36 | Undecanal, 2-methyl- | 110-41-8 | Aldehyde | 184 | 4.85 |
| 37 | 10-Undecenal | 112-45-8 | Aldehyde | 168 | 4.05 |
| 38 | 4-Methyl-3-decen-5-ol | 81782-77-6 | Alcohol | 170 | |
| 39 | Benzoic acid, 2-hydroxy-, cyclohexyl ester | 25485-88-5 | Ester | 220 | 4.48 |
| 40 | 4H-Inden-4-one, 1,2,3,5,6,7-hexahydro-1,1,2,3,3-pentamethyl- | 33704-61-9 | Ketone | 206 | 3.99 |
| 41 | N-2,4-Dimethyl-3-cyclohexenemethylene methyl anthranilate | 68738-99-8 | Schiffs base | n/a | 4.78 |
| 42 | 2-Buten-1-ol, 2-ethyl-4-(2,2,3-trimethyl-3-cyclopenten-1-yl)- | 28219-61-6 | Alcohol | 208 | 4.43 |
| 43 | Acetic acid, hexyl ester | 142-92-7 | Ester | 144 | 2.83 |
| 44 | 1,6-Octadien-3-ol, 3,7-dimethyl- | 78-70-6 | Alcohol | 154 | 2.55 |
| 45 | Cyclohexanol, 2-(1,1-dimethylethyl)-, acetate | 88-41-5 | Ester | 198 | 4.06 |
| 46 | 2-Butanone, 4-(4-hydroxyphenyl)- | 5471-51-2 | Ketone | 164 | 1.07 |

TABLE 2-continued

| | Chemical Name | CAS | Functionality | M Wt | clogP |
|---|---|---|---|---|---|
| 47 | Ethanone, 1-(2,3,4,7,8,8a-hexahydro-3,6,8,8-tetramethyl-1H-3a,7-methanoazulen-5-yl)-, [3R-(3.alpha.,3a.beta.,7.beta.,8a.alpha.)]- | 32388-55-9 | Ketone | 246 | 4.75 |
| 48 | Cyclododecane, (ethoxymethoxy)- | 58567-11-6 | Ether | 242 | 5.48 |
| 49 | Cyclohexane, 3-ethoxy-1,1,5-trimethyl-, cis- | 24691-15-4 | Ether | 156 | 3.93 |
| 50 | 1,3-Benzodioxole-5-carboxaldehyde | 120-57-0 | Ether/aldehyde | 150 | 1.14 |
| 51 | Benzoic acid, 2-hydroxy-, phenylmethyl ester | 118-58-1 | Ester | 228 | 4.22 |
| 52 | 2-Cyclopenten-1-one, 2-methyl-3-(2-pentenyl)- | 11050-62-7 | Ketone | 164 | 2.64 |
| 53 | Oxacyclohexadecen-2-one | 34902-57-3 | Lactone | 238 | 5.40 |
| 54 | 4-Cyclopentadecen-1-one, (Z)- | 0014595-54-1 | Ketone | 222 | n/a |
| 55 | Benzoic acid, 2-[(7-hydroxy-3,7-dimethyloctylidene)amino]-, methyl | 89-43-0 | Schiffs base | 305 | 4.17 |
| 56 | 4,7-Methano-3aH-indene-3a-carboxylic acid, octahydro-, ethyl ester, (3a.alpha.,4.beta.,7.beta.,7a.alpha.)- | 80623-07-0 | Ester | 209 | 3.37 |
| 57 | Benzoic acid, 2-hydroxy-, 3-hexenyl ester, (Z)- | 65405-77-8 | Ester | 220 | 4.61 |
| 58 | Benzoic acid, 2-amino-, methyl ester | 134-20-3 | Ester | 151 | 2.02 |
| 59 | Benzoic acid, 2-hydroxy-, hexyl ester | 6259-76-3 | Ester | 222 | 5.09 |
| 60 | Carbonic acid, 4-cycloocten-1-yl methyl ester | 87731-18-8 | Ester | 184 | 2.77 |
| 61 | 5-Cyclohexadecen-1-one | 37609-25-9 | Ketone | 236 | 5.97 |
| 62 | Cyclohexanepropanoic acid, 2-propenyl ester | 705-87-5 | Ester | 196 | 3.93 |
| 63 | Pentanoic acid, 2-methyl-, ethyl ester, (S)- | 28959-02-6 | Ester | 144 | 2.61 |
| 64 | 3-Buten-2-one, 4-(2,6,6-trimethyl-1-cyclohexen-1-yl)-, (E)- | 79-77-6 | Ketone | 192 | 3.77 |
| 65 | 1,3-Dioxolane, 2,4-dimethyl-2-(5,6,7,8-tetrahydro-5,5,8,8-tetramethyl-2-naphthalenyl)-, cis- | 131812-51-6 | Ether | 288 | 6.27 |
| 66 | 2,6-Octadienenitrile, 3,7-dimethyl- | 5146-66-7 | Nitrile | 227 | 3.25 |
| 67 | 2,6-Nonadienenitrile, 3,7-dimethyl- | 61792-11-8 | Nitrile | 163 | 3.78 |
| 68 | 3-Cyclohexene-1-carboxaldehyde, dimethyl- | 27939-60-2 | Aldehyde | 138 | 2.53 |
| 69 | Oxacyclohexadecan-2-one | 106-02-5 | Lactone | 240 | 6.29 |
| 70 | Methy-2-methyl-3-(4-tert butylphenyl)propylidenanthranilate | 91-51-0 | Schiffs base | 337 | 6.31 |
| 71 | Acetic acid, (3-methylbutoxy)-, 2-propenyl ester | 67634-00-8 | Ester | 186 | 2.38 |
| 72 | 9-Undecenal, 2,6,10-trimethyl- | 141-13-9 | Aldehyde | 210 | 5.16 |
| 73 | Cyclopentanone, 3-methyl-2-pentyl- | 13074-63-0 | Ketone | 168 | 3.46 |

In any of the aforementioned aspects, if the perfume oil or composition comprises an ester perfume ingredient, when said perfume oil or composition comprises an ester perfume component said ester perfume may have one or more of the following characteristics: branching or pendant rings in at least one of the alpha, beta or gamma positions; branching or pendant rings in at least one of the alpha or beta positions; or at least one tertiary carbon atom in the alpha position. While not being bound by theory, it is believed that the aforementioned perfume ester characteristics result in increased perfume ester stability, and thus perfume composition stability, when said perfume ester in is the presence of an enzyme that can hydrolyze ester bonds, for example, enzymes classed in EC 3.1.1, such as lipases.

In any of the aforementioned aspects of the invention, said perfume oil or composition typically contains no more than about 5%, or even none of the perfume components selected from the group consisting of Acetic acid, phenylmethyl ester; Benzene ethanol; Butanoic acid, 2-methyl-, ethyl ester; 4H-Pyran-4-one, 2-ethyl-3-hydroxy-; Benzaldehyde, 4-hydroxy-3-methoxy-; Benzaldehyde, 3-ethoxy-4-hydroxy-; 3-Hexen-1-ol, acetate, (Z)-; Butanoic acid, 2-methyl-, 1-; methylethyl ester; 3-Decanone, 1-hydroxy-; 2-Heptanone; Benzaldehyde; Propanenitrile, 3-(3-hexenyloxy)-, (Z)-; 2-Butanone, 4-phenyl-; 2-Hexen-1-ol; 2(3H)-Furanone, 5-butyldihydro-.

Processes of Making Perfume Compositions

Perfume compositions of the present invention may be made by ad-mixing of perfume raw materials, which are typically liquids. Certain perfume raw materials are solid materials and can require gentle heat to homogenise with the rest of the perfume. The perfume blend can also comprise a significant proportion of a diluent (e.g dipropylene glycol), an antioxidant or a solubilising material. Solubilisers can be particularly advantageous where the surfactant level is low in order to disperse the perfume in a predominantly hydrophilic matrix such as aqueous liquid cleaners.

Perfume Delivery Methods

Any of the aforementioned aspects of the perfume compositions may be combined with other materials to produce any of the following delivery systems for delivering additional perfume oils into the detergent composition: spray-on perfume oils, sprayed directly onto detergent composition or components thereof, starch encapsulate delivery systems, porous carrier material delivery systems, coated porous carrier material delivery systems, microencapsulate delivery systems. Preferably, detergent comopositions of the invention will comprise encapsulates and spray-on perfume. Suitable methods of producing the aforementioned delivery systems may be found in one or more of the following U.S. Pat. Nos. 6,458,754; 5,656,584; 6,172,037; 5,955,419 and 5,691,383 and WIPO publications WO 94/28017, WO 98/41607, WO 98/52527. Such delivery systems may be used alone, in combination with other or even in combination with the neat sprayed on or admixed perfume compositions of the present invention in a consumer product.

In addition to the lipase enzyme and encapsulated perfume particles, the detergent compositions of the invention will also contain one or more conventional detergent ingredients and/or detergent adjunct ingredients.

Optional Detersive Adjuncts

The detergent compositions of the invention may be in any convenient form such as powdered or granular solids, bars, tablets or non-aqueous liquids, including gel and paste forms. Other forms of cleaning composition include other institutional and/or household cleaning compositions such as liquid or solid cleaning and disinfecting agents, including antibacterial cleaners car or carpet shampoos, denture cleaners, hard surface cleaners, for example for kitchen and/or bathroom use optionally for cleaning metal, hair shampoos, shower gels, bath foam as well as cleaning auxiliaries such as bleach additives and "stain stick" or pre-treat types. When present in the granular form the detergent compositions of the present invention are preferably those having an overall bulk density of from 350 to 1200 g/l, more preferably 450 to 1000 g/l or even 500 to 900 g/l. Preferably, the detergent particles of the detergent composition in a granular form have a size average particle size of from 200 μm to 2000 μm, preferably from 350 μm to 600 μm.

Generally the detergent compositions of the invention will be mixed with other detergent particles including combinations of agglomerates, spray-dried powders and/or dry added materials such as bleaching agents, enzymes etc.

As a preferred embodiment, the conventional detergent ingredients are selected from typical detergent composition components such as detersive surfactants and detersive builders. Optionally, the detergent ingredients can include one or more other detersive adjuncts or other materials for assisting or enhancing cleaning performance, treatment of the substrate to be cleaned, or to modify the aesthetics of the detergent composition. Usual detersive adjuncts of detergent compositions include the ingredients set forth in U.S. Pat. No. 3,936,537, Baskerville et al. and in Great Britain Patent Application No. 9705617.0, Trinh et al., published Sep. 24, 1997. Such adjuncts are included in detergent compositions at their conventional art-established levels of use, generally from 0% to about 80% of the detergent ingredients, preferably from about 0.5% to about 20% and can include color speckles, suds boosters, suds suppressors, antitarnish and/or anticorrosion agents, soil-suspending agents, soil release agents, dyes, fillers, optical brighteners, germicides, alkalinity sources, hydrotropes, antioxidants, enzymes, enzyme stabilizing agents, solvents, solubilizing agents, chelating agents, clay soil removal/anti-redeposition agents, polymeric dispersing agents, processing aids, fabric softening components, static control agents, bleaching agents, bleaching activators, bleach stabilizers, etc.

As described above, detergent compositions comprising the particles of the invention will comprise at least some of the usual detergent adjunct materials, such as agglomerates, extrudates, other spray dried particles having different composition to those of the invention, or dry added materials. Conventionally, surfactants are incorporated into agglomerates, extrudates or spray dried particles along with solid materials, usually builders, and these may be admixed with the spray dried particles of the invention. However, as described above some or all of the solid material may be replaced with the particles of the invention.

The detergent adjunct materials are typically selected from the group consisting of detersive surfactants, builders, polymeric co-builders, bleach, chelants, enzymes, anti-redeposition polymers, soil-release polymers, polymeric soil-dispersing and/or soil-suspending agents, dye-transfer inhibitors, fabric-integrity agents, suds suppressors, fabric-softeners, flocculants, perfumes, whitening agents, photobleach and combinations thereof.

The precise nature of these additional components, and levels of incorporation thereof will depend on the physical form of the composition or component, and the precise nature of the washing operation for which it is to be used.

A highly preferred adjunct component is a surfactant. Preferably, the detergent composition comprises one or more surfactants. Typically, the detergent composition comprises (by weight of the composition) from 0% to 50%, preferably from 5% and more preferably from 10 or even 15 wt % to 40%, or to 30%, or to 20% one or more surfactants. Preferred surfactants are anionic surfactants, non-ionic surfactants, cationic surfactants, zwitterionic surfactants, amphoteric surfactants, cationic surfactants and mixtures thereof.

Preferred anionic surfactants comprise one or more moieties selected from the group consisting of carbonate, phosphate, sulphate, sulphonate and mixtures thereof. Preferred anionic surfactants are $C_{8-18}$ alkyl sulphates and $C_{8-18}$ alkyl sulphonates. Suitable anionic surfactants incorporated alone or in mixtures in the compositions of the invention are also the $C_{8-18}$ alkyl sulphates and/or $C_{8-18}$ alkyl sulphonates optionally condensed with from 1 to 9 moles of $C_{1-4}$ alkylene oxide per mole of $C_{8-18}$ alkyl sulphate and/or $C_{8-18}$ alkyl sulphonate. The alkyl chain of the $C_{8-18}$ alkyl sulphates and/or $C_{8-18}$ alkyl sulphonates may be linear or branched, preferred branched alkyl chains comprise one or more branched moieties that are $C_{1-6}$ alkyl groups. Other preferred anionic surfactants are $C_{8-18}$ alkyl benzene sulphates and/or $C_{8-18}$ alkyl benzene sulphonates. The alkyl chain of the $C_{8-18}$ alkyl benzene sulphates and/or $C_{8-18}$ alkyl benzene sulphonates may be linear or branched, preferred branched alkyl chains comprise one or more branched moieties that are $C_{1-6}$ alkyl groups.

Other preferred anionic surfactants are selected from the group consisting of: $C_{8-18}$ alkenyl sulphates, $C_{8-18}$ alkenyl sulphonates, $C_{8-18}$ alkenyl benzene sulphates, $C_{8-18}$ alkenyl benzene sulphonates, $C_{8-18}$ alkyl di-methyl benzene sulphate, $C_{8-18}$ alkyl di-methyl benzene sulphonate, fatty acid ester sulphonates, di-alkyl sulphosuccinates, and combinations thereof. The anionic surfactants may be present in the salt form. For example, the anionic surfactant may be an alkali metal salt of one or more of the compounds selected from the group consisting of: $C_{8-18}$ alkyl sulphate, $C_{8-18}$ alkyl sulphonate, $C_{8-18}$ alkyl benzene sulphate, $C_{8-18}$ alkyl benzene sulphonate, and combinations thereof. Preferred alkali metals are sodium, potassium and mixtures thereof. Typically, the detergent composition comprises from 10% to 30 wt % anionic surfactant.

Preferred non-ionic surfactants are selected from the group consisting of: $C_{8-18}$ alcohols condensed with from 1 to 9 of $C_1$-$C_4$ alkylene oxide per mole of $C_{8-18}$ alcohol, $C_{8-18}$ alkyl N—$C_{1-4}$ alkyl glucamides, $C_{8-18}$ amido $C_{1-4}$ dimethyl amines, $C_{8-18}$ alkyl polyglycosides, glycerol monoethers, polyhydroxyamides, and combinations thereof. Typically the detergent compositions of the invention comprises from 0 to 15, preferably from 2 to 10 wt % non-ionic surfactant.

Preferred cationic surfactants are quaternary ammonium compounds. Preferred quaternary ammonium compounds comprise a mixture of long and short hydrocarbon chains, typically alkyl and/or hydroxyalkyl and/or alkoxylated alkyl chains. Typically, long hydrocarbon chains are $C_{8-18}$ alkyl chains and/or $C_{8-18}$ hydroxyalkyl chains and/or $C_{8-18}$ alkoxylated alkyl chains. Typically, short hydrocarbon chains are $C_{1-4}$ alky chains and/or $C_{1-4}$ hydroxyalkyl chains and/or $C_{1-4}$ alkoxylated alkyl chains. Typically, the detergent composition comprises (by weight of the composition) from 0% to 20% cationic surfactant.

Preferred zwitterionic surfactants comprise one or more quaternized nitrogen atoms and one or more moieties selected from the group consisting of: carbonate, phosphate, sulphate, sulphonate, and combinations thereof. Preferred zwitterionic surfactants are alkyl betaines. Other preferred zwitterionic surfactants are alkyl amine oxides. Catanionic surfactants which are complexes comprising a cationic surfactant and an anionic surfactant may also be included. Typically, the molar ratio of the cationic surfactant to anionic surfactant in the complex is greater than 1:1, so that the complex has a net positive charge.

A further preferred adjunct component is a builder. Preferably, the detergent composition comprises (by weight of the composition and on an anhydrous basis) from 20% to 50% builder. Preferred builders are selected from the group consisting of: inorganic phosphates and salts thereof, preferably orthophosphate, pyrophosphate, tri-poly-phosphate, alkali metal salts thereof, and combinations thereof; polycarboxylic acids and salts thereof, preferably citric acid, alkali metal salts of thereof, and combinations thereof; aluminosilicates, salts thereof, and combinations thereof, preferably amorphous aluminosilicates, crystalline aluminosilicates, mixed amorphous/crystalline aluminosilicates, alkali metal salts thereof, and combinations thereof, most preferably zeolite A, zeolite P, zeolite MAP, salts thereof, and combinations thereof; silicates such as layered silicates, salts thereof, and combinations thereof, preferably sodium layered silicate; and combinations thereof.

A preferred adjunct component is a bleaching agent. Preferably, the detergent composition comprises one or more bleaching agents. Typically, the composition comprises (by weight of the composition) from 1% to 50% of one or more bleaching agent. Preferred bleaching agents are selected from the group consisting of sources of peroxide, sources of peracid, bleach boosters, bleach catalysts, photo-bleaches, and combinations thereof. Preferred sources of peroxide are selected from the group consisting of: perborate monohydrate, perborate tetra-hydrate, percarbonate, salts thereof, and combinations thereof. Preferred sources of peracid are selected from the group consisting of: bleach activator typically with a peroxide source such as perborate or percarbonate, preformed peracids, and combinations thereof. Preferred bleach activators are selected from the group consisting of: oxy-benzene-sulphonate bleach activators, lactam bleach activators, imide bleach activators, and combinations thereof. A preferred source of peracid is tetra-acetyl ethylene diamine (TAED) and peroxide source such as percarbonate. Preferred oxy-benzene-sulphonate bleach activators are selected from the group consisting of: nonanoyl-oxy-benzene-sulponate, 6-nonamido-caproyl-oxy-benzene-sulphonate, salts thereof, and combinations thereof. Preferred lactam bleach activators are acyl-caprolactams and/or acyl-valerolactams. A preferred imide bleach activator is N-nonanoyl-N-methyl-acetamide.

Preferred preformed peracids are selected from the group consisting of N,N-pthaloyl-amino-peroxycaproic acid, nonyl-amido-peroxyadipic acid, salts thereof, and combinations thereof. Preferably, the STW-composition comprises one or more sources of peroxide and one or more sources of peracid. Preferred bleach catalysts comprise one or more transition metal ions. Other preferred bleaching agents are di-acyl peroxides. Preferred bleach boosters are selected from the group consisting of: zwitterionic imines, anionic imine polyions, quaternary oxaziridinium salts, and combinations thereof. Highly preferred bleach boosters are selected from the group consisting of: aryliminium zwitterions, aryliminium polyions, and combinations thereof. Suitable bleach boosters are described in U.S. Pat. Nos. 360,568, 5,360,569 and 5,370,826.

A preferred adjunct component is an anti-redeposition agent. Preferably, the detergent composition comprises one or more anti-redeposition agents. Preferred anti-redeposition agents are cellulosic polymeric components, most preferably carboxymethyl celluloses.

A preferred adjunct component is a chelant. Preferably, the detergent composition comprises one or more chelants. Preferably, the detergent composition comprises (by weight of the composition) from 0.01% to 10% chelant. Preferred chelants are selected from the group consisting of: hydroxyethane-dimethylene-phosphonic acid, ethylene diamine tetra(methylene phosphonic) acid, diethylene triamine pentacetate, ethylene diamine tetraacetate, diethylene triamine penta(methyl phosphonic) acid, ethylene diamine disuccinic acid, and combinations thereof.

A preferred adjunct component is a dye transfer inhibitor. Preferably, the detergent composition comprises one or more dye transfer inhibitors. Typically, dye transfer inhibitors are polymeric components that trap dye molecules and retain the dye molecules by suspending them in the wash liquor. Preferred dye transfer inhibitors are selected from the group consisting of: polyvinylpyrrolidones, polyvinylpyridine N-oxides, polyvinylpyrrolidone-polyvinylimidazole copolymers, and combinations thereof.

Preferred adjunct components include other enzymes. Preferably, the detergent composition comprises one or more additional enzymes. Preferred enzymes are selected from then group consisting of: amylases, arabinosidases, carbohydrases, cellulases, chondroitinases, cutinases, dextranases, esterases, β-glucanases, gluco-amylases, hyaluronidases, keratanases, laccases, ligninases, lipoxygenases, malanases, mannanases, oxidases, pectinases, pentosanases, peroxidases, phenoloxidases, phospholipases, proteases, pullulanases, reductases, tannases, transferases, xylanases, xyloglucanases, and combinations thereof. Preferred additional enzymes are selected from the group consisting of: amylases, carbohydrases, cellulases, proteases, and combinations thereof.

A preferred adjunct component is a fabric integrity agent. Preferably, the detergent composition comprises one or more fabric integrity agents. Typically, fabric integrity agents are polymeric components that deposit on the fabric surface and prevent fabric damage during the laundering process. Preferred fabric integrity agents are hydrophobically modified celluloses. These hydrophobically modified celluloses reduce fabric abrasion, enhance fibre-fibre interactions and reduce dye loss from the fabric. A preferred hydrophobically modified cellulose is described in WO99/14245. Other preferred fabric integrity agents are polymeric components and/or oligomeric components that are obtainable, preferably obtained, by a process comprising the step of condensing imidazole and epichlorhydrin.

A preferred adjunct component is a salt. Preferably, the detergent composition comprises one or more salts. The salts can act as alkalinity agents, buffers, builders, co-builders, encrustation inhibitors, fillers, pH regulators, stability agents, and combinations thereof. Typically, the detergent composition comprises (by weight of the composition) from 5% to 60% salt. Preferred salts are alkali metal salts of aluminate, carbonate, chloride, bicarbonate, nitrate, phosphate, silicate, sulphate, and combinations thereof. Other preferred salts are alkaline earth metal salts of aluminate, carbonate, chloride, bicarbonate, nitrate, phosphate, silicate, sulphate, and combinations thereof. Especially preferred salts are sodium sulphate, sodium carbonate, sodium bicarbonate, sodium silicate, sodium sulphate, and combinations thereof. Optionally, the alkali metal salts and/or alkaline earth metal salts may be anhydrous.

A preferred adjunct component is a soil release agent. Preferably, the detergent composition comprises one or more soil release agents. Typically, soil release agents are polymeric compounds that modify the fabric surface and prevent the redeposition of soil on the fabric. Preferred soil release agents are copolymers, preferably block copolymers, comprising one or more terephthalate unit. Preferred soil release agents are copolymers that are synthesised from dimethylterephthalate, 1,2-propyl glycol and methyl capped polyethyleneglycol. Other preferred soil release agents are anionically end capped polyesters.

A preferred adjunct component is a soil suspension agent. Preferably, the detergent composition comprises one or more soil suspension agents. Preferred soil suspension agents are polymeric polycarboxylates. Especially preferred are polymers derived from acrylic acid, polymers derived from maleic acid, and co-polymers derived from maleic acid and acrylic acid. In addition to their soil suspension properties, polymeric polycarboxylates are also useful co-builders for laundry detergents. Other preferred soil suspension agents are alkoxylated polyalkylene imines. Especially preferred alkoxylated polyalkylene imines are ethoxylated polyethylene imines, or ethoxylated-propoxylated polyethylene imine. Other preferred soil suspension agents are represented by the formula:

$$\text{bis}((C_2H_5O)(C_2H_4O)_n(CH_3)\text{—}N^+\text{—}C_xH_{2x}\text{—}N^+\text{—}(CH_3)\text{-bis}((C_2H_4O)_n(C_2H_5O)),$$

wherein, n=from 10 to 50 and x=from 1 to 20. Optionally, the soil suspension agents represented by the above formula can be sulphated and/or sulphonated.

Softening System

The detergent compositions of the invention may comprise softening agents for softening through the wash such as clay optionally also with flocculant and enzymes.

Further more specific description of suitable detergent components can be found in WO97/11151.

Washing Method

The invention also includes methods of washing textiles comprising cleaning, treating and/or masking the odour of a situs for example, a surface or fabric. Such method comprises contacting the situs such as a textile with an aqueous solution comprising the detergent composition of the invention. The invention may be particularly beneficial at low water temperatures such as below 30° C. or below 25 or 20° C. Typically the aqueous wash liquor will comprise at least 100 ppm, or at least 500 ppm of the detergent composition

EXAMPLE 1

Perfume Compositions

| | | Composition | | | |
|---|---|---|---|---|---|
| Common Name | CAS | 1 | 2 | 3 | 4 |
| Yara Yara | 93-04-9 | 5 | | | |
| Diphenyl Oxide | 101-84-8 | 2 | 7 | | 5 |
| Iso Eugenol | 120-11-6 | | | 6 | |
| Eugenol | 97-53-0 | | | 4 | 5 |
| Dynascone ® | 56973-85-4 | 1 | 1.5 | | |
| Delta damascone | 71048-82-3 | 2 | | 4 | |
| Ionone Gamma Methyl | 127-51-5 | | | 20 | 5 |
| Nectaryl | 95962-14-4 | 20 | | | |
| Ionone alpha | 127-41-3 | | | 4 | |
| Dartanol | 28219-61-6 | | | 8 | |
| Levosandol ® | 28219-61-6 | | | 8 | |
| Hedione ® | 24851-98-7 | | 25 | | 40 |
| Dihydro IsoJasmonate ® | 37172-53-5 | | 10 | 12 | 5 |
| Frutene | 17511-60-3 | 25 | | | |
| Flor Acetate | 2500-83-6 | 25 | | | |
| Amyl Salicylate | 2050-08-0 | | 20 | | |
| Coumarin | 91-64-5 | | | 4 | |
| Dupical | 30168-23-1 | | 1 | | |
| Florhydral ® | 125109-85-5 | | 2 | | |
| Lilial | 80-54-6 | | 20 | 20 | |
| Hexyl Cinnamic aldehyde | 101-86-0 | | | | 40 |
| Aldehyde C10 | 10486-19-8 | 5 | | | |
| Lauric Aldehyde | 112-54-9 | | 1.5 | | |
| Peonile ® | 104621-98-0 | 15 | 12 | | |
| Patchouli | | | | 10 | |
| Balance | | 100 | 100 | 100 | 100 |

EXAMPLE 2

Perfumes Made With Compositions from Example 1

| Common Name | CAS | Perfume Example A | B | C | D |
|---|---|---|---|---|---|
| Composition 1 | n/a | 61 | | | |
| Composition 2 | n/a | | 45 | | |
| Composition 3 | n/a | | | 26 | |
| Composition 4 | n/a | | | | 10 |
| Cetalox | 3738-00-9 | | 0.5 | | |
| Delphone | 4819-67-4 | | | | 2 |
| Delta Muscenone | 82356-51-2 | | | 1 | |
| Undecalactone | 104-67-6 | 1 | | | |
| Aldehyde MNA | 110-41-8 | 2 | | | |
| Undecavertol | 81782-77-6 | | 2 | | |
| Cyclohexyl salicylate | 25485-88-5 | | 3 | | |
| Cashmeran ® | 33704-61-9 | | | 1 | |
| Agrumea | 68738-99-8 | | | 3 | |
| Hexyl Acetate | 142-92-7 | 5 | | | |
| Verdox | 88-41-5 | 10 | | | |
| Methyl Cedrylone | 32388-55-9 | | 2 | | |
| Heliotropin | 120-57-0 | | | 1 | |
| Benzyl Salicylate | 118-58-1 | | | 4 | |
| Iso Jasmone | 11050-62-7 | | | | 1 |
| Habanolide ® | 34902-57-3 | | | 5 | 5 |
| Aurantiol | 89-43-0 | | | | 1 |
| Cis-3-hexenyl salicylate | 65405-77-8 | | 3 | | |
| Methyl Anthranilate | 134-20-3 | 1 | | | |
| Hexyl Salicylate | 6259-76-3 | | 4 | | |
| Manzanate | 28959-02-6 | 1 | | | |
| Geranyl Nitrile | 5146-66-7 | 2 | | | |
| Ligustral | 27939-60-2 | 1 | 2 | | |
| Allyl Amyl Glycolate | 67634-00-8 | | 1 | | |
| Adoxal | 141-13-9 | | 0.5 | | |
| Jasmylone | 13074-63-0 | | | | 1 |
| Benzyl Acetate | 140-11-4 | | | 10 | 58 |
| Phenyl Ethyl Alcohol | 60-12-8 | | 34 | | |
| Vanillin | 121-33-5 | | | 1 | |
| Ethyl Vanillin | 121-32-4 | | | 0.5 | |
| Cis 3 hexenyl acetate | 3681-71-8 | | 1 | | |
| Cinnamalva | 1885-38-7 | | | 1 | |
| Benzyl Acetone | 2550-26-7 | | | 20 | 20 |
| Beta Gamma Hexenol | 2305-21-7 | 1 | 2 | | 1 |
| Gamma Octalactone | 104-50-7 | | | 0.5 | 1 |
| D-Limonene | 138-86-3 | 15 | | 26 | |
| Total | | 100 | 100 | 100 | 100 |

In the following encapsulation and detergent compositions the perfume component is a perfume according to the present invention and/or Examples 1 and 2 above.

Manufacture of Modified Starch Encapsulated Perfume Particles

EXAMPLE 3

1. 225 g of CAPSUL modified starch (National Starch & Chemical) is added to 450 g of water at 24° C.
2. The mixture is agitated at 600 RPM (turbine impeller 2 inches in diameter) for 20 minutes.
3. 75 g perfume oil is added near the vortex of the starch solution.
4. The emulsion formed is agitated for an additional 20 minutes (at 600 RPM).
5. Upon achieving a perfume droplet size of less than 15 microns, the emulsion is pumped to a spray drying tower and atomized through a spinning disk with co-current airflow for drying. The inlet air temperature is set at 205-210° C., the exit air temperature is stabilized at 98-103° C.
6. Dried particles of the starch encapsulated perfume oil are collected at the dryer outlet.

Analysis of the finished perfume particle (all % based on weight):

| | |
|---|---|
| Total Perfume Oil | 24.56% |
| Encapsulated Oil/Free or Surface Oil | 24.46%/0.10% |
| Starch | 72.57% |
| Moisture | 2.87% |
| Particle Size Distribution | |
| <50 micrometers | 16% |
| 50-500 micrometers | 83% |
| >500 micrometers | 1% |

EXAMPLE 4

In a suitable container 500 g of HiCap 100 modified starch (supplied by National Starch & Chemical) are dissolved into 1000 g of deionised water. Once a homogenous solution is achieved, 40 g of anhydrous citric acid is added to the starch solution. The mixture is agitated for 10 minutes to dissolve the citric acid. At this point, 600 g of perfume is added to the mixture. The emulsion is then agitated with a high shear mixer (ARD-Barico) for 10 more minutes.

The mixture is then spray dried in a Production Minor cocurrent spray dryer manufactured by Niro A/S. A rotary atomising disc type FS 1, also from Niro A/S, is used. The air inlet temperature is 200° C. and the outlet temperature 90° C. Disc speed is set at 28,500 rpm. The tower is stabilized at these conditions by spraying water for 30 minutes before spray drying the emulsion. The dried particles are collected in a cyclone.

Detergent compositions comprising the encapsulated perfumes of examples 3 and 4 are exemplified in Table 3 below:

TABLE 3

| Ingredient | A | B | C | D | E |
|---|---|---|---|---|---|
| Sodium linear $C_{11-13}$ alkylbenzene sulfonate | 11% | 12% | 10% | 18% | 15% |
| $R_2N^+(CH_3)_2(C_2H_4OH)$, wherein $R_2 = C_{12-14}$ alkyl group | 0.6% | 1% | | | 0.6% |
| Mid chain methyl branched sodium $C_{12}$-$C_{14}$ linear alkyl sulfate | 1.4% | 1.2% | 1% | | |

TABLE 3-continued

| Ingredient | A | B | C | D | E |
|---|---|---|---|---|---|
| Sodium $C_{12-18}$ linear alkyl sulfate | 0.7% | 0.5% | | | |
| $C_{12-18}$ linear alkyl ethoxylate condensed with an average of 3-9 moles of ethylene oxide per mole of alkyl alcohol | 1% | 4% | 2% | 3% | 1% |
| Citric acid | 2% | 1.5% | | | 2% |
| Sodium tripolyphosphate (anhydrous weight given) | | | | 25% | 22% |
| Sodium carboxymethyl cellulose | 0.2% | 0.2% | | 0.3% | |
| Sodium polyacrylate polymer having a weight average molecular weight of from 3000 to 5000 | 2.0% | 0.5% | 1% | | 0.7% |
| Copolymer of maleic/acrylic acid, having a weight average molecular weight of from 50,000 to 90,000, wherein the ratio of maleic to acrylic acid is from 1:3 to 1:4 (Sokalan CP5 from BASF) | 2.1% | 3.5% | 7% | 2.0% | 2.1% |
| Diethylene triamine pentaacetic acid | 0.2% | | 1.0% | 0.2% | 0.3% |
| Ethylene diamine disuccinic acid | | 0.5% | | 0.6% | 0.5% |
| Proteolytic enzyme having an enzyme activity of from 15 mg/g to 70 mg/g | 0.2% | 0.2% | 0.5% | 0.4% | 0.3% |
| Amyolitic enzyme having an enzyme activity of from 25 mg/g to 50 mg/g | 0.2% | 0.2% | 0.3% | 0.4% | 0.3% |
| Lipex ® enzyme from Novozymes having an enzyme activity of 5 mg/g to 25 mg/g | 0.2% | 0.5% | 0.1% | 0.5% | 0.3% |
| Anhydrous sodium perborate monohydrate | | | 20% | 5% | 8% |
| Sodium percarbonate | 10% | 12% | | | |
| Magnesium sulfate | 0.1% | 0.5% | | | |
| Nonanoyl oxybenzene sulfonate | | | | 2% | 1.2% |
| Tetraacetylethylenediamine | 3% | 4% | 2% | 0.6% | 0.8% |
| Brightener | 0.1% | 0.1% | 0.2% | 0.1% | 0.1% |
| Sodium carbonate | 10% | 10% | 10% | 19% | 22% |
| Sodium sulfate | 20% | 15% | 5% | 5% | 6% |
| Zeolite A | 25% | 20% | 20% | 17% | 14% |
| Sodium silicate (2.0 R) | | 0.2% | | 1% | 1% |
| Crystalline layered silicate | 3% | 5% | 10% | | |
| Photobleach | 0.002% | | | | |
| Polyethylene oxide having a weight average molecular weight from 100 to 10,000 | 2% | 1% | | | |
| Perfume spray-on | 0.2% | 0.5% | 0.25% | 0.1% | |
| Starch encapsulated perfume from example 1 or example 2 | 0.4% | 0.5% | 1% | 0.4% | 1.5% |
| Silicone based suds suppressor | 0.05% | 0.05% | | | 0.02% |
| Soap | | 1.2% | 1.5% | 1.0% | |
| Miscellaneous and moisture | To 100% | To 100% | To 100% | To 100% | To 100% |

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition comprising:

1. a lipase which is a polypeptide having an amino acid sequence which: (a) has at least 90% identity with the wild-type lipase derived from *Humicola lanuginosa* strain DSM 4109; (b) compared to said wild-type lipase, comprises a substitution of an electrically neutral or negatively charged amino acid at the surface of the three-dimensional structure within 15 Angstroms of E1 or Q249 at any of positions 1-11, 169, 171, 217-225, 228-240, 243-247 with a positively charged amino acid; and (c) comprises a peptide addition at the C-terminal; and/or (d) comprises a peptide addition a the N-terminal and/or (e) meets the following limitations: i) comprises a negative amino acid in position E210 of said wild-type lipase; ii) comprises a negatively charged amino acid in the region corresponding to positions 90-101 of said wild-type lipase; and iii) comprises a neutral or negative amino acid at a position corresponding to N94 or said wild-type lipase and/or has a negative or neutral net electric charge in the region corresponding to positions 90-101 of said wild-type lipase; and
2. an encapsulated perfume particle comprising (a) an at least partially water-soluble solid matrix comprising one or more water-soluble hydroxylic compounds; and (b) a perfume oil encapsulated by the solid matrix, wherein encapsulated perfume particle has a size of from about 1 micron to about 1000 microns.

2. A detergent composition according to claim 1 wherein said encapsulated perfume oil comprises at least 5% by weight of at least one perfume ingredient having a boiling point at $36KNm^{-2}$ (760 mmHg) of 260° C. or lower and a calculated $\log_{10}$ of its octanol/water coefficient P (ClogP), of at least 3.0.

3. A detergent composition according to claim 1, wherein said encapsulated perfume oil comprises an ester derived from a fatty acid having from 1 to 7 carbon atoms.

4. A detergent composition according to claim 1 wherein said encapsulated perfume oil is present in addition to an additional perfume oil, said additional perfume oil being present as a sprayed-on component.

5. A detergent composition according to claim 4 wherein said perfume oil comprises an ester derived from a fatty acid having from 1 to 7 carbon atoms and at least 90 wt% of the ester derived from a fatty acid having from 1 to 7 carbon atoms is present in the encapsulated perfume particle.

6. A detergent composition according to claim 1 wherein said encapsulated perfume particle comprises benzyl acetate and/or phenylethyl acetate.

7. A detergent composition according to claim 1 wherein said perfume oil in the encapsulated perfume particle is absorbed or adsorbed onto a carrier and both perfume oil and carrier are encapsulated.

8. A detergent composition according to claim 1 comprising a perfume composition comprising the perfume oil in the encapsulated perfume particle and any optional additional perfume oil in the detergent composition, said perfume composition comprising at least 5% of one or more perfume ingredients having a molecular weight of greater than 0 but less than or equal to 350 daltons, at least 80% of said one or more perfume components having a cLogP of at least 2.4, said perfume composition comprising at least 5% of said one or more perfume components having a cLogP of at least 2.4.

9. A washing process comprising laundering textile articles in an aqueous solution comprising the detergent composition according to claim 1.

10. A washing process according to claim 9 wherein the aqueous solution is at a temperature below 30° C.

11. A detergent composition of claim 1, wherein said encapsulated perfume particle has a size of from 50 microns to about 500 microns.

12. A detergent composition of claim 1, wherein said detergent composition comprises from 0.01% to about 50.0% of said perfume particle.

13. A detergent composition of claim 1, wherein said detergent composition comprises from 0.05% to about 8.0% of said perfume particle.

14. A detergent composition of claim 1, wherein said perfume is adsorbed or adsorbed onto a carrier prior to encapsulation.

15. A detergent composition of claim 1, wherein said one or more water-soluble hydroxylic compounds comprises a starch.

16. A detergent composition of claim 1, wherein said one or more water-soluble hydroxylic compounds comprises a natural or synthetic gum selected from the group consisting of alginate esters, carrageenin, agar-agar, pectic acid, and natural gums such as gum arabic, gum tragacanth and gum karaya, chitin and chitosan, cellulose and cellulose derivatives, and mixtures thereof.

17. A detergent composition comprising:

1. a lipase which is a polypeptide having an amino acid sequence which: (a) has at least 90% identity with the wild-type lipase derived from *Humicola lanuginosa* strain DSM 4109; (b) compared to said wild-type lipase, comprises a substitution of an electrically neutral or negatively charged amino acid at the surface of the three-dimensional structure within 15 Angstroms of E1 or Q249 at any of positions 228-240 with a positively charged amino acid; and (c) comprises a peptide addition at the C-terminal; and/or (d) comprises a peptide addition a the N-terminal and/or (e) meets the following limitations: i) comprises a negative amino acid in position E210 of said wild-type lipase; ii) comprises a negatively charged amino acid in the region corresponding to positions 90-101 of said wild-type lipase; and iii) comprises a neutral or negative amino acid at a position corresponding to N94 or said wild-type lipase and/or has a negative or neutral net electric charge in the region corresponding to positions 90-101 of said wild-type lipase; and
2. an encapsulated perfume particle comprising (a) an at least partially water-soluble solid matrix comprising one or more water-soluble hydroxylic compounds; and (b) a perfume oil encapsulated by the solid matrix, wherein encapsulated perfume particle has a size of from about 1 micron to about 1000 microns.

18. A detergent composition according to claim 17 wherein said encapsulated perfume oil comprises at least 5% by weight of at least one perfume ingredient having a boiling point at $36KNm^{-2}$ (760 mmHg) of 260° C. or lower and a calculated $\log_{10}$ of its octanol/water coefficient P (ClogP), of at least 3.0.

19. A detergent composition comprising:

1. a lipase which is a polypeptide having an amino acid sequence which: (a) has at least 90% identity with the wild-type lipase derived from *Humicola lanuginosa* strain DSM 4109; (b) compared to said wild-type lipase, comprises a mutation T231R and a mutation N233R; and (c) comprises a peptide addition at the C-terminal; and/or (d) comprises a peptide addition a the N-terminal and/or (e) meets the following limitations: i) comprises a negative amino acid in position E210 of said wild-type lipase; ii) comprises a negatively charged amino acid in the region corresponding to positions 90-101 of said wild-type lipase; and iii) comprises a neutral or negative amino acid at a position corresponding to N94 or said wild-type lipase and/or has a negative or neutral net electric charge in the region corresponding to positions 90-101 of said wild-type lipase; and
2. an encapsulated perfume particle comprising (a) an at least partially water-soluble solid matrix comprising one or more water-soluble hydroxylic compounds; and (b) a perfume oil encapsulated by the solid matrix, wherein encapsulated perfume particle has a size of from about 1 micron to about 1000 microns.

20. A detergent composition according to claim 19 wherein said encapsulated perfume oil comprises at least 5% by weight of at least one perfume ingredient having a boiling point at $36KNm^{-2}$ (760 mmHg) of 260° C. or lower and a calculated $\log_{10}$ of its octanol/water coefficient P (ClogP), of at least 3.0.

* * * * *

UNITED STATES PATENT AND TRADEMARK OFFICE

CERTIFICATE OF CORRECTION

PATENT NO. : 7,569,528 B2
APPLICATION NO. : 11/287943
DATED : August 4, 2009
INVENTOR(S) : Neil J. Lant et al.

It is certified that error appears in the above-identified patent and that said Letters Patent is hereby corrected as shown below:

Column 8

Line 35, delete "nitrites" and insert --nitriles--.

Signed and Sealed this
Fourth Day of October, 2011

David J. Kappos

David J. Kappos
*Director of the United States Patent and Trademark Office*